US011436921B2

(12) United States Patent
Li

(10) Patent No.: US 11,436,921 B2
(45) Date of Patent: Sep. 6, 2022

(54) VEHICLE/ROAD INTERACTION SIGNAL CONTROL METHOD AND APPARATUS

(71) Applicant: IE-CHENG TECHNOLOGY (TIANJIN) CO., LTD., Tianjin (CN)

(72) Inventor: Chunming Li, Tianjin (CN)

(73) Assignee: IE-CHENG TECHNOLOGY (TIANJIN) CO., LTD., Tianjin (CN)

( * ) Notice: Subject to any disclaimer, the term of this patent is extended or adjusted under 35 U.S.C. 154(b) by 0 days.

(21) Appl. No.: 17/310,434

(22) PCT Filed: Mar. 31, 2020

(86) PCT No.: PCT/CN2020/082570

§ 371 (c)(1),
(2) Date: Aug. 2, 2021

(87) PCT Pub. No.: WO2020/156597

PCT Pub. Date: Aug. 6, 2020

(65) Prior Publication Data

US 2022/0130242 A1 Apr. 28, 2022

(30) Foreign Application Priority Data

Feb. 3, 2019 (CN) ..... 201910106898.3

(51) Int. Cl.
*G08G 1/08* (2006.01)

(52) U.S. Cl.
CPC ..... *G08G 1/08* (2013.01)

(58) Field of Classification Search
CPC ..... G08G 1/08; G08G 1/081; G08G 1/07; G08G 1/0145; G08G 1/04; G08G 1/087
See application file for complete search history.

(56) References Cited

U.S. PATENT DOCUMENTS 6,317,058 B1 * 11/2001 Lemelson ..... G08G 1/087 340/905
9,412,271 B2 * 8/2016 Sharma ..... G08G 1/22
(Continued)

FOREIGN PATENT DOCUMENTS

CN 102074119 A 5/2011
CN 102842238 A 12/2012
(Continued)

OTHER PUBLICATIONS

International Search Report and Written Opinion dated Jul. 3, 2020, in connection with International Patent Application No. PCT/CN2020/082570, filed Mar. 31, 2020, 12 pgs. (including translation).
(Continued)

*Primary Examiner* — Hoi C Lau
(74) *Attorney, Agent, or Firm* — Chiesa Shahinian & Giantomasi PC

(57) ABSTRACT

Provided are a vehicle/road interaction signal control method and apparatus, including: expanding the range of an intersection, extending to an upstream intersection along each approaching vehicle direction, and determining signal phases according to traffic flow conditions; acquiring the current speed and the current position of each moving target in each phase; according to the current speed and the current position of each moving target in each phase, calculating the time for each moving target to reach the intersection; according to the time for each moving target to reach the intersection, obtaining a time sequence of the moving targets in each phase for reaching the intersection; according to the time sequence of the moving targets in each phase for reaching the intersection, determining a release order and a release duration for each phase; sending information to onboard terminals.

20 Claims, 3 Drawing Sheets

(56) References Cited

U.S. PATENT DOCUMENTS

| | | | | |
|---|---|---|---|---|
| 9,633,560 | B1 * | 4/2017 | Gao | G08G 1/07 |
| 10,147,316 | B2 * | 12/2018 | Radomy | G08G 1/07 |
| 10,490,066 | B2 * | 11/2019 | Green | G06V 20/54 |
| 10,954,638 | B2 * | 3/2021 | Brown | G08G 1/081 |
| 2006/0155427 | A1 * | 7/2006 | Yang | G08G 1/07 701/1 |
| 2008/0094250 | A1 * | 4/2008 | Myr | G08G 1/081 340/909 |
| 2011/0175753 | A1 * | 7/2011 | Free | G08G 1/08 901/50 |
| 2018/0096595 | A1 * | 4/2018 | Janzen | G08G 1/04 |
| 2018/0151064 | A1 * | 5/2018 | Xu | G08G 1/0133 |
| 2019/0250639 | A1 * | 8/2019 | Xu | G08G 1/0133 |
| 2020/0242922 | A1 * | 7/2020 | Dulberg | G08G 1/096708 |
| 2022/0130242 | A1 * | 4/2022 | Li | G08G 1/08 |

FOREIGN PATENT DOCUMENTS

| | | | |
|---|---|---|---|
| CN | 103956060 | A | 7/2014 |
| CN | 103985263 | A | 8/2014 |
| CN | 104637315 | A | 5/2015 |
| CN | 105551276 | A | 5/2016 |
| CN | 106340190 | A | 1/2017 |
| CN | 107248297 | A | 10/2017 |
| CN | 108831143 | A | 11/2018 |
| CN | 109671282 | A | 4/2019 |
| JP | 2007-257196 | A | 10/2007 |
| KR | 20180050973 | A | 5/2018 |

OTHER PUBLICATIONS

Notification to Grant Patent Right for Invention dated Mar. 24, 2020, in connection with Chinese Patent Application No. 201910106898.3, 3 pgs. (including translation).

Second Office Action dated Oct. 12, 2019, in connection with Chinese Patent Application No. 201910106898.3, 16 pgs. (including translation).

Third Office Action dated Jan. 8, 2020, in connection with Chinese Patent Application No. 201910106898.3, 7 pgs. (including translation).

* cited by examiner

VEHICLE/ROAD INTERACTION SIGNAL CONTROL METHOD AND APPARATUS

CROSS-REFERENCE TO RELATED APPLICATIONS

This application is a national stage under 35 U.S.C. 371 of International Patent Application No. PCT/CN2020/082570, filed Mar. 31, 2020, which claims priority to Chinese Patent Application No. 201910106898.3, filed Feb. 3, 2019, the disclosures of which are incorporated herein by reference in their entirety.

TECHNICAL FIELD

The present disclosure relates to the technical field of traffic control, in particular to a vehicle/road interaction signal control method (i.e., a method for controlling a vehicle/road interaction signal) and apparatus.

BACKGROUND ART

Most of current road network structures have plane intersections, conflict may occur when traffic flows from different directions pass through an intersection point at the same time, and a traffic signal control system may separate in time the traffic flows that may conflict by a controlling manner.

Current traffic signal control manner mainly include timing control and inductive control. The timing control is to divide one day into several periods according to periodic flow patterns, and correspondingly set different control parameters such as periods and green signal ratios according to allocated periods; and the inductive control is to provide a detection section upstream of an intersection or in a position close to the intersection, and set a light duration according to traffic condition of vehicles. The above control manners mainly adjust the green light duration on the basis of a queuing length at the intersection, thereby causing delay of stopping at the intersection, and low traffic efficiency.

SUMMARY

In view of this, the present disclosure aims at providing a vehicle/road interaction signal control method and a vehicle/road interaction signal control apparatus, which can avoid the delay caused by stopping at the intersection, improve the traffic efficiency of the whole intersection, and reduce the energy consumption.

In a first aspect, an embodiment of the present disclosure provides a vehicle/road interaction signal control method, wherein the method includes:

expanding a range of an intersection, which is extended to an upstream intersection along each vehicle approaching direction, and determining signal phases according to traffic flow conditions;

acquiring a current speed and a current position of each moving target in each phase;

calculating duration for each of the moving targets in each of the phases to reach a cross intersection according to the current speed and the current position of each of the moving targets in each of the phases;

arranging the duration for the moving targets in each of the phases to reach the cross intersection in an ascending order, to obtain a time sequence of the moving targets in each of the phases reaching the cross intersection;

determining a release order and a release duration of each of the phases according to the time sequence of the moving targets in each of the phases reaching the cross intersection;

determining green light start time of each of the phases according to a minimum value in the time sequence of each of the phases;

determining a green light duration of each of the phases according to a width of the time sequence of each of the phases; and sending the green light start time of each of the phases and the green light duration of each of the phases to a vehicle-mounted terminal of the moving target, so that the vehicle-mounted terminal of the moving target calculates a guiding speed range according to the green light start time of each of the phases and the green light duration of each of the phases, and a vehicle control unit adjusts a vehicle speed according to the guiding speed range.

In combination with the first aspect, an embodiment of the present disclosure provides a first possible example of the first aspect, wherein the calculating duration for each of the moving targets in each of the phases to reach a cross intersection according to the current speed and the current position of each of the moving targets in each of the phases comprises:

calculating a distance of each of the moving targets from the cross intersection according to the current position of each of the moving targets; and calculating the duration for each of the moving targets to reach the cross intersection according to the distance of each of the moving targets from the cross intersection and the current speed of each of the moving targets.

In combination with the first possible example of the first aspect, an embodiment of the present disclosure provides a second possible example of the first aspect, wherein the calculating the duration for each of the moving targets to reach the cross intersection according to the distance of each of the moving targets from the cross intersection and the current speed of each of the moving targets comprises:

calculating the duration for each of the moving targets to reach the cross intersection according to the following formula:

$$t_i = s_i / v_i$$

where $t_i$ is the duration for each of the moving targets to reach the cross intersection, $s_i$ is the distance of each of the moving targets from the cross intersection, and $v_i$ is the current speed of each of the moving targets.

In combination with the first aspect, an embodiment of the present disclosure provides a third possible example of the first aspect, wherein the determining a release order and a release duration of each of the phases according to the time sequence of the moving targets in each of the phases reaching the cross intersection comprises: determining the release order of each of the phases in accordance with the first-come-first-served principle according to the minimum value of the time sequence of the moving targets in each of the phases reaching the cross intersection, wherein the speed of the moving target is not greater than the road speed limit.

In combination with the first aspect, an embodiment of the present disclosure provides a fourth possible example of the first aspect, wherein the determining a green light duration of each of the phases according to a width of the time sequence of each of the phases comprises:

determining a green light duration of each of the phases according to a difference between a maximum value and a minimum value in the time sequence of each of the phases, wherein preset minimum green light duration≤green light duration of the phase≤preset maximum green light duration.

In combination with the fourth possible example of the first aspect, an embodiment of the present disclosure provides a fifth possible example of the first aspect, wherein the determining a release order and a release duration of each of the phases according to the time sequence of the moving targets in each of the phases reaching the cross intersection comprises:

obtaining an ending moment of the phase according to a green light initial moment, the green light duration, yellow light duration, and full red duration of the phase, wherein the green light initial moment of the current phase is arranged in sequence after the ending moment of a previous phase, and serves as the green light initial moment of the current phase.

In combination with the fifth possible example of the first aspect, an embodiment of the present disclosure provides a sixth possible example of the first aspect, wherein the method further comprises:

obtaining light duration information of each of the phases according to the green light initial moment, the green light duration, the yellow light duration, and the full red duration of each of the phases.

In combination with the sixth possible example of the first aspect, an embodiment of the present disclosure provides a seventh possible example of the first aspect, wherein the method further comprises:

monitoring all moving targets of each of the phases according to the light duration information;

calculating remaining duration when all moving targets of each of the phases pass through the cross intersection; and allocating the remaining duration to the next phase.

In combination with the first aspect, an embodiment of the present disclosure provides an eighth possible example of the first aspect, wherein the method further comprises:

receiving a passing request sent by the vehicle-mounted terminal of the moving target; and setting passing duration as a full red phase according to the passing request, and sending the full red phase to the vehicle-mounted terminal of the moving target, so that the vehicle-mounted terminal of the moving target displays the full red phase on a display screen, wherein the vehicle-mounted terminal of the moving target is a vehicle-mounted terminal of a special service vehicle.

In combination with the first aspect, an embodiment of the present disclosure provides a ninth possible example of the first aspect, wherein the method further comprises:

sending the guiding speed range to an LED display screen, so that the LED display screen displays the guiding speed range, wherein the LED display screen is provided above a lane.

In combination with the fourth possible example of the first aspect, an embodiment of the present disclosure provides a tenth possible example of the first aspect, wherein the preset minimum green light duration is the duration for ensuring the moving target to pass through the intersection and is set as 15 s, and the preset maximum green light duration is set according to the road traffic flow and not greater than 90 s.

In combination with the first aspect, an embodiment of the present disclosure provides an eleventh possible example of the first aspect, wherein the moving target comprises one or several of pedestrian and vehicle.

In combination with the first aspect, an embodiment of the present disclosure provides a twelfth possible example of the first aspect, wherein the method further comprises:

outputting a traffic signal as a yellow flashing state, if none of the phases detects a road right request and then the time sequence is empty.

In combination with the first aspect, an embodiment of the present disclosure provides a thirteenth possible example of the first aspect, wherein the method further comprises:

displaying the light duration information allocated to each of the phases on a road section of an electronic map.

In a second aspect, an embodiment of the present disclosure provides a vehicle/road interaction signal control apparatus, wherein the apparatus comprises:

a phase determining unit, configured to expand a range of an intersection, which is extended to an upstream intersection along each vehicle approaching direction, and determine signal phases according to traffic flow conditions;

an acquiring unit, configured to acquire a current speed and a current position of each moving target in each phase;

a calculating unit, configured to calculate the duration for each of the moving targets in each of the phases to reach the cross intersection according to the current speed and the current position of each of the moving targets in each of the phases;

an ordering unit, configured to arrange the duration for the moving targets in each of the phases to reach the cross intersection in an ascending order, to obtain a time sequence of the moving targets in each of the phases reaching the cross intersection;

a release determining unit, configured to determine the release order and the release duration of each of the phases according to the time sequence of the moving targets in each of the phases reaching the cross intersection;

a green light start time determining unit, configured to determine green light start time of each of the phases according to a minimum value in the time sequence of each of the phases;

a green light duration determining unit, configured to determine a green light duration of each of the phases according to a width of the time sequence of each of the phases; and a sending unit, configured to send the green light start time of each of the phases and the green light duration of each of the phases to a vehicle-mounted terminal of the moving target, so that the vehicle-mounted terminal of the moving target calculates a guiding speed range according to the green light start time of each of the phases and the green light duration of each of the phases, and a vehicle control unit adjusts a vehicle speed according to the guiding speed range.

In combination with the second aspect, an embodiment of the present disclosure provides a first possible example of the second aspect, wherein the calculating unit includes:

calculating a distance of each of the moving targets from the cross intersection according to the current position of each of the moving targets; and calculating the duration for each of the moving targets to reach the cross intersection according to the distance of each of the moving targets from the cross intersection and the current speed of each of the moving targets.

In combination with the first possible example of the second aspect, an embodiment of the present disclosure provides a second possible example of the second aspect, wherein the calculating unit comprises:

calculating the duration for each of the moving targets to reach the cross intersection according to the following formula:

$$t_i = s_i / v_i$$

where $t_i$ is the duration for each of the moving targets to reach the cross intersection, $s_i$ is the distance of each of the moving targets from the cross intersection, and $v_i$ is the current speed of each of the moving targets.

In combination with the second aspect, an embodiment of the present disclosure provides a third possible example of the second aspect, wherein the release determining unit comprises:

determining the release order of each of the phases in accordance with the first-come-first-served principle according to a minimum value of the time sequence of the moving targets in each of the phases reaching the cross intersection, wherein the speed of the moving target is not greater than the road speed limit.

In combination with the second aspect, an embodiment of the present disclosure provides a fourth possible example of the second aspect, wherein the green light duration determining unit comprises:

determining a green light duration of each of the phases according to a difference between a maximum value and a minimum value in the time sequence of each of the phases, wherein preset minimum green light duration≤green light duration of the phase≤preset maximum green light duration.

In combination with the fourth possible example of the second aspect, an embodiment of the present disclosure provides a fifth possible example of the second aspect, wherein the release determining unit comprises:

obtaining an ending moment of the phase according to a green light initial moment, the green light duration, yellow light duration, and full red duration of the phase, wherein the green light initial moment of the current phase is arranged in sequence after the ending moment of a previous phase, and serves as the green light initial moment of the current phase.

In combination with the fifth possible example of the second aspect, an embodiment of the present disclosure provides a sixth possible example of the second aspect, wherein the apparatus further comprises:

a light duration information acquiring unit, configured to obtain light duration information of each of the phases according to the green light initial moment, the green light duration, the yellow light duration, and the full red duration of each of the phases.

In combination with the sixth possible example of the second aspect, an embodiment of the present disclosure provides a seventh possible example of the second aspect, wherein the apparatus further comprises:

a monitoring unit, configured to monitor all moving targets of each of the phases according to the light duration information;

a remaining duration calculating unit, configured to calculate remaining duration when all moving targets of each of the phases pass through the cross intersection; and an allocating unit, configured to allocate the remaining duration to the next phase.

In combination with the second aspect, an embodiment of the present disclosure provides an eighth possible example of the second aspect, wherein the apparatus further comprises:

a passing request receiving unit, configured to receive a passing request sent by a vehicle-mounted terminal of the moving target; and a setting unit, configured to set passing duration as a full red phase according to the passing request, and send the full red phase to the vehicle-mounted terminal of the moving target, so that the vehicle-mounted terminal of the moving target displays the full red phase on a display screen, wherein the vehicle-mounted terminal of the moving target is a vehicle-mounted terminal of a special service vehicle.

In combination with the second aspect, an embodiment of the present disclosure provides a ninth possible example of the second aspect, wherein the apparatus further comprises:

a guiding speed range sending unit, configured to send the guiding speed range to an LED display screen, so that the LED display screen displays the guiding speed range, wherein the LED display screen is provided above a lane.

In combination with the fourth possible example of the second aspect, an embodiment of the present disclosure provides a tenth possible example of the second aspect, wherein the preset minimum green light duration is the duration for ensuring the moving target to pass through the intersection and is set as 15 s, and the preset maximum green light duration is set according to the road traffic flow and not greater than 90 s.

In combination with the second aspect, an embodiment of the present disclosure provides an eleventh possible example of the second aspect, wherein the moving target comprises one or several of pedestrian and vehicle.

In combination with the second aspect, an embodiment of the present disclosure provides a twelfth possible example of the second aspect, wherein the apparatus further comprises:

a road right request detecting unit, configured to output a traffic signal as a yellow flashing state in case where none of the phases detects a road right request and then the time sequence is empty.

In combination with the second aspect, an embodiment of the present disclosure provides a thirteenth possible example of the second aspect, wherein the apparatus further comprises:

a displaying unit, configured to display the light duration information allocated to each of the phases on a road section of an electronic map.

In a third aspect, an embodiment of the present disclosure provides an electronic device, including a memory and a processor, the memory storing a computer program executable on the processor, wherein the processor implements the steps of the method according to the first aspect above and any possible embodiments of the first aspect when executing the computer program.

In a fourth aspect, an embodiment of the present disclosure provides a computer readable medium having processor-executable non-volatile program codes, wherein the program codes enable the processor to execute the steps of the method according to the first aspect and any possible embodiments of the first aspect.

The embodiments of the present disclosure provide a vehicle/road interaction signal control method and a vehicle/road interaction signal control apparatus, including: expanding a range of an intersection, which is extended to an upstream intersection along each vehicle approaching direction, and determining signal phases according to traffic flow conditions; acquiring a current speed and a current position of each moving target in each phase; calculating duration for each of the moving targets to reach a cross intersection according to the current speed and the current position of each of the moving targets in each of the phases; obtaining a time sequence of the moving targets in each phase reaching the intersection according to the duration for each moving target to reach the cross intersection; determining a release order and a release duration of each phase according to the time sequence of the moving targets in each phase reaching the intersection; sending the above information to a vehicle-mounted terminal; and calculating, by the vehicle-mounted terminal, a guiding speed range in real time according to the information, wherein the vehicle may reach the intersection during a green light period just by adjusting a vehicle speed according to road conditions in combination with the guiding speed range, thus avoiding the delay caused by stopping at the intersection, improving the traffic efficiency of the whole intersection, and reducing the energy consumption.

Other features and advantages of the present disclosure will be illustrated in following description, and will partially become obvious from the description, or be understood by implementing the present disclosure. The objectives and other advantages of the present disclosure are achieved and obtained through the structures specifically indicated in the description, the claims, and the accompanying drawings.

In order to make the above objectives, features, and advantages of the present disclosure more apparent and understandable, preferred embodiments are particularly illustrated below in combination with attached accompanying drawings to make following detailed description.

BRIEF DESCRIPTION OF DRAWINGS

In order to more clearly illustrate technical solutions in specific embodiments of the present disclosure or the prior art, accompanying drawings which need to be used for description of the specific embodiments or the prior art will be introduced briefly below. Apparently, the accompanying drawings in the following description merely show some embodiments of the present disclosure, and those ordinarily skilled in the art still could obtain other accompanying drawings in light of these accompanying drawings, without using creative efforts.

REFERENCE SIGNS

Figure 1:
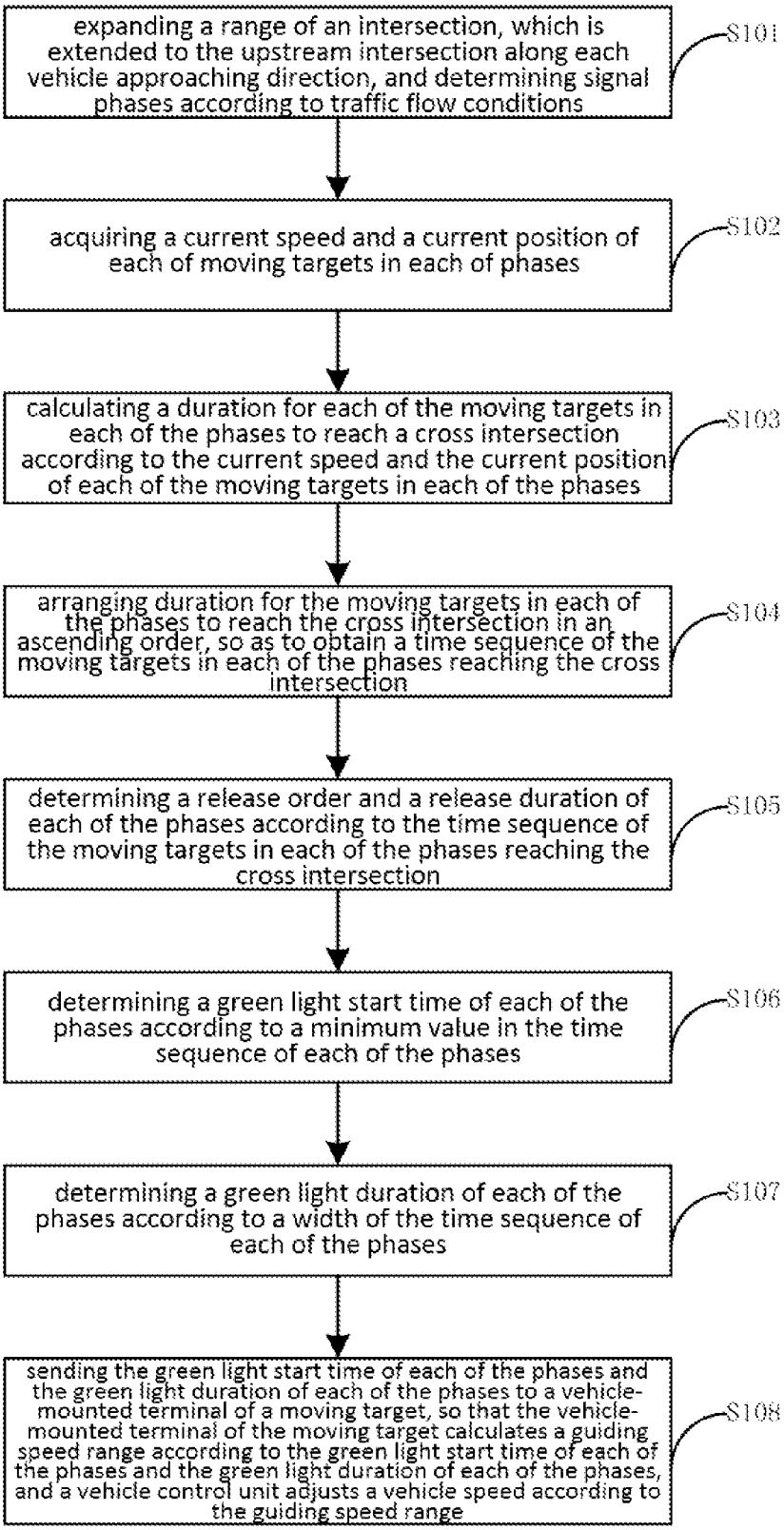
FIG. 1 is a flowchart of a vehicle/road interaction signal control method provided in Embodiment 1 of the present disclosure.

10—phase determining unit;
20—acquiring unit;
30—calculating unit;
40—ordering unit;
50—release determining unit;
60—green light start time determining unit;
70—green light duration determining unit;
80—sending unit.

DETAILED DESCRIPTION OF EMBODIMENTS

In order to make objectives, technical solutions, and advantages of the embodiments of the present disclosure clearer, the technical solutions of the present disclosure will be described clearly and completely below in conjunction with accompanying drawings, and apparently, the embodiments described are some but not all embodiments of the present disclosure. All of other embodiments obtained by those ordinarily skilled in the art based on the embodiments in the present disclosure without using creative efforts shall fall within the scope of protection of the present disclosure.

Most of current road network structures have plane intersections, conflict will occur when traffic flows from different directions pass through an intersection point at the same time, but a traffic signal control system may separate in time traffic flows that may conflict by a controlling mode.

The control modes include timing control and inductive control. The timing control is to divide one day into several periods according to periodic flow patterns, and set different control parameters such as periods and green signal ratios according to allocated periods; and the inductive control is to provide a detection section upstream of an intersection or in a position close to the intersection, and set light duration according to reaching condition of vehicles.

The above control modes are unreasonable in allocating the light duration to traffic flows in different directions, thus causing the delay of stopping at the intersection, and low traffic efficiency.

An embodiment of the present disclosure provides a vehicle/road interaction signal control method and a vehicle/road interaction signal control apparatus, including: expanding a range of an intersection, which is extended to an upstream intersection along each vehicle approaching direction, and determining signal phases according to traffic flow conditions; acquiring a current speed and a current position of each moving target in each phase; calculating the duration for each moving target to reach a cross intersection according to the current speed and the current position of each moving target in each phase; obtaining a time sequence of the moving targets in each phase reaching the intersection according to duration for each moving target to reach the cross intersection; determining a release order and a release duration of each phase according to the time sequence of the moving targets in each phase reaching the intersection; sending the above information to a vehicle-mounted terminal; and calculating, by the vehicle-mounted terminal, a guiding speed range in real time according to the information, wherein the vehicle may reach the intersection during a green light period just by adjusting a vehicle speed according to road conditions in combination with the guiding speed range, thus avoiding the delay caused by stopping at the intersection, improving the traffic efficiency of the whole intersection, and reducing the energy consumption.

In order to facilitate understanding the present embodiment, the embodiment of the present disclosure is introduced in detail below.

Embodiment 1

FIG. 1 is a flowchart of a vehicle/road interaction signal control method provided Embodiment 1 of the present disclosure.

Referring to FIG. 1, the method includes following steps:

step S101, expanding a range of an intersection, which is extended to an upstream intersection along each vehicle approaching direction, and determining signal phases according to traffic flow conditions.

Here, the phase is a state in which one or several traffic flows obtain the same cyclical display of signal light colors (red light-green light-yellow light) at a signal intersection at the same time. Therefore, a minimum signal period is set as Cmin, and a maximum signal period is set as Cmax. By extending the range of an intersection to the upstream intersection along each vehicle approaching direction, performing phase division on the moving targets in each direction according to the traffic flow conditions, and allocating the duration to each phase as needed, the traffic efficiency is improved.

Figure 2:
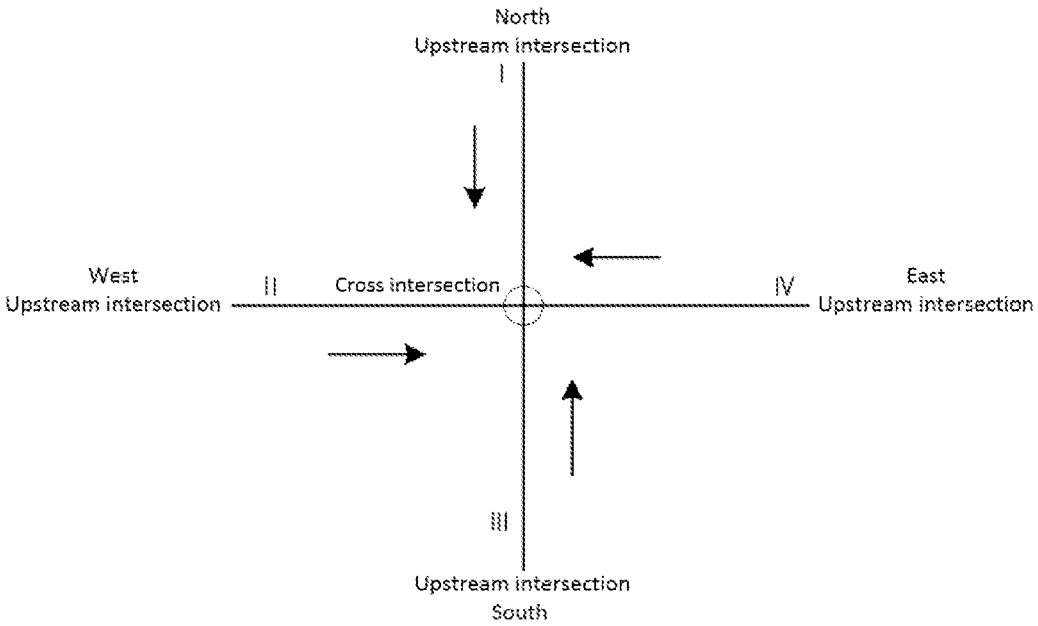
FIG. 2 is a schematic view of division of multiple phases provided in Embodiment 1 of the present disclosure.

Reference may be made to FIG. 2 for the division of the phases. Taking a cross intersection as an example, four phases are divided in four directions: east, west, south, and north, but the intersection, not limited to the cross intersection, may also be other forms of intersections, and may be divided into two phases or three phases.

In the process of traveling from north to south, a moving target in the north travels from an upstream intersection to the cross intersection, which may be defined as a first phase I;

in the process of traveling from west to east, a moving target in the west travels from an upstream intersection to the cross intersection, which may be defined as a second phase II;

in the process of traveling from south to north, a moving target in the south travels from an upstream intersection to the cross intersection, which may be defined as a third phase III; and in the process of traveling from east to west, a moving target in the east travels from an upstream intersection to the cross intersection, which may be defined as a fourth phase IV.

Step S102, acquiring a current speed and a current position of each moving target in each phase.

Here, a road speed limit is set to have a minimum value Vmin, and a maximum value Vmax, a control range of intersection includes an intersection dense area and an intersection sparse area, wherein the intersection dense area extends to the upstream intersection along the vehicle approaching direction, and the intersection sparse area extends to 2*Cmax*V along the vehicle approaching direction, where V is the road speed limit.

After the control range of intersection is acquired, the current speed and the current position of each moving target in each phase are acquired according to the control range of intersection.

Step S103, calculating the duration for each moving target in each phase to reach the cross intersection according to the current speed and the current position of each moving target in each phase.

Step S104, arranging the duration for the moving targets in each phase to reach the cross intersection in an ascending order, to obtain a time sequence of the moving targets in each phase reaching the cross intersection.

Specifically, if the moving targets in each direction from the upstream intersection to the cross intersection are divided, four phases are obtained, which are the first phase I, the second phase II, the third phase III, and the fourth phase IV, respectively. Here, the four phases are taken as an example, but it is not limited to four phases, and two phases or three phases are also feasible.

The duration for each moving target to reach the cross intersection in the first phase I, the second phase II, the third phase III, and the fourth phase IV is acquired, and arranged in an ascending order, so as to obtain a moving target sequence corresponding to the four phases, thereby acquiring the release order, releasing each phase in sequence according to the release order, and allocating the light time as needed, thus improving the traffic efficiency, and avoiding the delay caused by stopping at the intersection.

Specifically, the moving target sequence corresponding to the first phase I is rank ($I_{t1}$, $I_{t2}$, $I_{t3}$, $I_{ti}$);

the moving target sequence corresponding to the second phase II is rank ($II_{t1}$, $II_{t2}$, $II_{t3}$, $II_{ti}$;

the moving target sequence corresponding to the third phase III is rank ($III_{t1}$, $III_{t2}$, $III_{t3}$, $III_{ti}$); and the moving target sequence corresponding to the fourth phase IV is rank ($IV_{t1}$, $IV_{t2}$, $IV_{t3}$, $IV_{ti}$).

Step S105, determining the release order and the release duration of each phase according to the time sequence of the moving targets in each phase reaching the cross intersection.

Step S106: determining green light start time of each phase according to a minimum value in the time sequence of each phase.

Step S107, determining a green light duration of each phase according to a width of the time sequence of each phase.

Step S108, sending the green light start time of each phase and the green light duration of each phase to a vehicle-mounted terminal of the moving target, so that the vehicle-mounted terminal of the moving target calculates a guiding speed range according to the green light start time of each phase and the green light duration of each phase, and a vehicle control unit adjusts a vehicle speed according to the guiding speed range.

Further, step S103 includes the following steps:

step S201: calculating a distance of each moving target from the cross intersection according to the current position of each moving target; and step S202: calculating the duration for each moving target to reach the cross intersection according to the distance of each moving target from the cross intersection and the current speed of each moving target.

Further, step S202 includes:

calculating the duration for each moving target to reach the cross intersection according to a formula (1):

$$t_i = s_i / v_i \tag{1}$$

In the above, $t_i$ is the duration for each moving target to reach the cross intersection, $s_i$ is the distance of each moving target from the cross intersection, and $v_i$ is the current speed of each moving target.

Further, step S105 includes the following step:

step S301, determining the release order of each phase in accordance with the first-come-first-served principle according to the minimum value of the time sequence of the moving targets in each phase reaching the cross intersection.

In the above, the speed of the moving target is not greater than the road speed limit.

Specifically, the time minimum value and the time maximum value are acquired from the moving target sequence corresponding to the first phase I, i.e., Imin=min $I_{t1}$, $I_{t2}$, $I_{t3}$, $I_{ti}$), Imax=max ($I_{t1}$, $I_{t2}$, $I_{t3}$, $I_{ti}$);

the time minimum value and the time maximum value are acquired from the moving target sequence corresponding to the second phase II, i.e., IImin=min ($II_{t1}$, $II_{t2}$, $II_{t3}$, $II_{ti}$), IImax=max ($II_{t1}$, $II_{t2}$, $II_{t3}$, $II_{ti}$);

the time minimum value and the time maximum value are acquired from the moving target sequence corresponding to the third phase III, i.e., IIImin=min ($III_{t1}$, $III_{t2}$, $III_{t3}$, $III_{ti}$), IIImax=max ($III_{t1}$, $III_{t2}$, $III_{t3}$, $III_{ti}$); and the time minimum value and the time maximum value are acquired from the moving target sequence corresponding to the fourth phase IV, i.e., IVmin=min ($IV_{t1}$, $IV_2$, $IV_{t3}$, $IV_{ti}$), IVmax=max ($IV_{t1}$, $IV_{t2}$, $IV_{t3}$, $IV_{ti}$).

Here, the time minimum values are selected from the moving target sequences corresponding to every phases, and arranged in an ascending order, and the release order of each phase is determined in accordance with the first-come-first-obtained principle. For example, the sequence order after the arrangement is the first phase I, the second phase II, the third phase III, and the fourth phase IV. Therefore, after the arrangement, the moving targets on the first phase are released first, and then the moving targets on the second phase, the moving targets on the third phase, and the moving targets on the fourth phase are released in sequence.

Further, step S107 includes the following step:

step S401: determining a green light duration of each phase according to a difference between the maximum value and the minimum value in the time sequence of each phase.

In the above, preset minimum green light duration≤green light duration of phase≤preset maximum green light duration.

Specifically, the time minimum values are selected from the moving target sequences corresponding to every phases, and arranged in an ascending order, the moving target sequence of each phase after the arrangement includes the time sequence corresponding to the first phase, the time sequence corresponding to the second phase, the time sequence corresponding to the third phase, and the time sequence corresponding to the fourth phase, then, the maximum value of the time sequence corresponding to the first phase, the maximum value of the time sequence corresponding to the second phase, the maximum value of the time sequence corresponding to the third phase, and the maximum value of the time sequence corresponding to the fourth phase are obtained, respectively.

The green light duration of the first phase is obtained according to the maximum value and the minimum value in the time sequence corresponding to the first phase;

the green light duration of the second phase is obtained according to the maximum value and the minimum value in the time sequence corresponding to the second phase;

the green light duration of the third phase is obtained according to the maximum value and the minimum value in the time sequence corresponding to the third phase; and the green light duration of the fourth phase is obtained according to the maximum value and the minimum value in the time sequence corresponding to the fourth phase.

Specifically, reference is made to a formula (2):

$$\begin{aligned} I_g &= I_{max} - I_{min} \\ II_g &= II_{max} - II_{min} \\ III_g &= III_{max} - III_{min} \\ IV_g &= IV_{max} - IV_{min} \end{aligned} \tag{2}$$

In the above, $I_g$ is the green light duration of the first phase, $I_{max}$ is the maximum value in the time sequence corresponding to the first phase, $I_{min}$ is the minimum value in the time sequence corresponding to the first phase, $II_g$ is the green light duration of the second phase, $II_{max}$ is the maximum value in the time sequence corresponding to the second phase, $II_{min}$ is the minimum value in the time sequence corresponding to the second phase, $III_g$ is the green light duration of the third phase, $III_{max}$ is the maximum value in the time sequence corresponding to the third phase, $III_{min}$ is the minimum value in the time sequence corresponding to the third phase, $IV_g$ is the green light duration of the fourth phase, $IV_{max}$ is the maximum value in the time sequence corresponding to the fourth phase, and $IV_{min}$ is the minimum value in the time sequence corresponding to the fourth phase.

It should be noted that, if the green light duration of the first phase is less than the preset minimum green light duration, the preset minimum green light duration is taken as the green light duration of the first phase; if the green light duration of the first phase is greater than the preset maximum green light duration, the preset maximum green light duration is taken as the green light duration of the first phase;

if the green light duration of the second phase is less than the preset minimum green light duration, the preset minimum green light duration is taken as the green light duration of the second phase; if the green light duration of the second phase is greater than the preset maximum green light duration, the preset maximum green light duration is taken as the green light duration of the second phase;

if the green light duration of the third phase is less than the preset minimum green light duration, the preset minimum green light duration is taken as the green light duration of the third phase; if the green light duration of the third phase is greater than the preset maximum green light duration, the preset maximum green light duration is taken as the green light duration of the third phase; and if the green light duration of the fourth phase is less than the preset minimum green light duration, the preset minimum green light duration is taken as the green light duration of the fourth phase; if the green light duration of the fourth phase is greater than the preset maximum green light duration, the preset maximum green light duration is taken as the green light duration of the fourth phase.

Further, step S105 includes the following step:

step S501, obtaining an ending moment of the phase according to a green light initial moment, the green light duration, yellow light duration, and full red duration of the phase.

In the above, the green light initial moment of the current phase is arranged in sequence after the ending moment of a previous phase, and serves as the green light initial moment of the current phase.

Further, the method further includes the following step:

step S601, obtaining light duration information of each phase according to the green light initial moment, the green light duration, the yellow light duration, and the full red duration of each phase.

Further, the method further includes the following steps:

step S701, monitoring all moving targets of each phase according to the light duration information;

step S702, calculating remaining duration when all moving targets of each phase pass through the cross intersection; and step S703, allocating the remaining duration to the next phase.

Specifically, in a current green light monitoring, system will continuously monitor matching condition between the confirmed light duration information and the moving target, and when all the moving targets pass through the cross intersection, the remaining duration is calculated, and the remaining duration is allocated to the next phase.

Further, the method further includes the following steps:

step S801: receiving a passing request sent by a vehicle-mounted terminal of a moving target; and step S802, setting passing duration as a full red phase according to the passing request, and sending the full red phase to the vehicle-mounted terminal of the moving target, so that the vehicle-mounted terminal of the moving target displays the full red phase on a display screen.

In the above, the vehicle-mounted terminal of the moving target is a vehicle-mounted terminal of a special service vehicle.

Specifically, the special service vehicle has the privilege of passing during red light, and when receiving the passing request sent by the vehicle-mounted terminal of the special service vehicle, the system sets the passing duration as the full red phase according to the above method, so as to avoid conflict with other vehicles, and the full red phase is displayed on the vehicle-mounted terminal of the special service vehicle.

Further, the method further includes the following step:

step S901, sending the guiding speed range to an LED display screen, so that the LED display screen displays the guiding speed range.

In the above, the LED display screen is provided above a lane.

Here, the guiding speed range is a speed range in which the moving target passes through the cross intersection in a green light period.

Specifically, the moving target may be a vehicle, each phase includes a plurality of vehicles, after the green light start time of each phase and the green light duration of each phase are acquired, the green light start time of each phase and the green light duration of each phase are sent to various vehicle-mounted terminals in corresponding phase, the vehicle-mounted terminals calculate the guiding speed range according to the green light start time of each phase and the green light duration of each phase, and the vehicle control unit on the vehicle controls the vehicle speed within this guiding speed range for travelling, so that the vehicle may reach the intersection in the green light period and pass therethrough quickly.

Further, the preset minimum green light duration is the duration for ensuring the moving target to pass through the intersection and is set as 15 s, and the preset maximum green light duration is set according to the road traffic flow and not greater than 90 s.

Further, the moving target includes one or more of pedestrian and vehicle.

Further, the method further includes:

outputting a traffic signal as a yellow flashing state if none of the phases detects a road right request and then the time sequence is empty.

Further, the method further includes:

displaying the light duration information allocated to each phase on a road section of an electronic map.

Herein, the light duration information allocated to each phase is displayed on the road section of the electronic map, so that when the moving target is farther from the cross intersection, the light duration information when the vehicle travels to the intersection can be acquired in time, thereby avoiding congestion of the moving target in the vicinity of the intersection, improving the traffic efficiency of the whole intersection, and reducing the energy consumption.

An embodiment of the present disclosure provides a vehicle/road interaction signal control method, including: expanding a range of an intersection, which is extended to an upstream intersection along each vehicle approaching direction, and determining signal phases according to traffic flow conditions; acquiring a current speed and a current position of each moving target in each phase; calculating the duration for each moving target to reach a cross intersection according to the current speed and the current position of each moving target in each phase; obtaining a time sequence of the moving targets in each phase reaching the intersection according to duration for each moving target to reach the cross intersection; determining a release order and a release duration of each phase according to the time sequence of the moving targets in each phase reaching the intersection; sending the above information to a vehicle-mounted terminal; and calculating, by the vehicle-mounted terminal, a guiding speed range in real time according to the information, wherein the vehicle may reach the intersection during a green light period just by adjusting a vehicle speed according to road conditions in combination with the guiding speed range, thus avoiding the delay caused by stopping at the intersection, improving the traffic efficiency of the whole intersection, and reducing the energy consumption.

Embodiment 2

Figure 3:
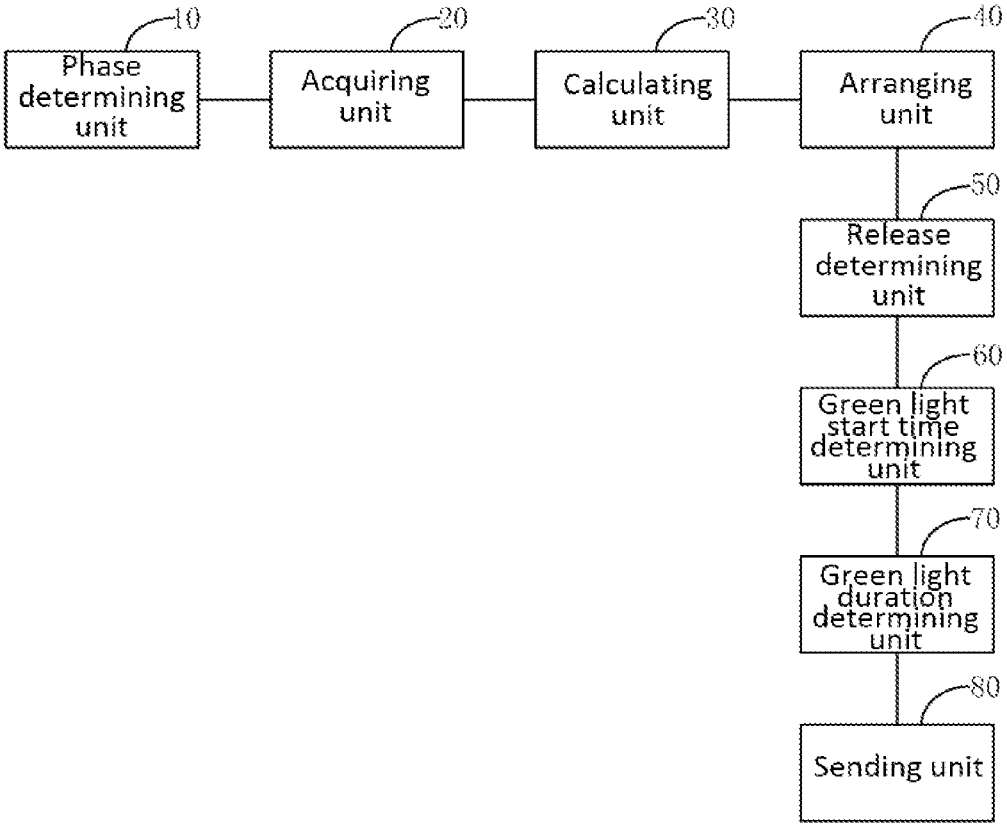
FIG. 3 is a schematic view of a vehicle/road interaction signal control apparatus provided in Embodiment 2 of the present disclosure.

FIG. 3 is a schematic view of a vehicle/road interaction signal control apparatus provided in Embodiment 2 of the present disclosure.

Referring to FIG. 3, the apparatus includes: a phase determining unit 10; an acquiring unit 20; a calculating unit 30; an ordering unit 40; a release determining unit 50; a green light start time determining unit 60; a green light duration determining unit 70; and a sending unit 80.

The phase determining unit 10 is configured to expand a range of an intersection, which is extended to an upstream intersection along each vehicle approaching direction, and determine signal phases according to traffic flow conditions;

the acquiring unit 20 is configured to acquire a current speed and a current position of each moving target in each phase;

the calculating unit 30 is configured to calculate the duration for each moving target in each phase to reach the cross intersection according to the current speed and the current position of each moving target in each phase;

the ordering unit 40 is configured to arrange the duration for the moving targets in each phase to reach the cross intersection in an ascending order, to obtain a time sequence of the moving targets in each phase reaching the cross intersection;

the release determining unit 50 is configured to determine the release order and the release duration of each phase according to the time sequence of the moving targets in each phase reaching the cross intersection;

the green light start time determining unit 60 is configured to determine green light start time of each phase according to a minimum value in the time sequence of each phase;

the green light duration determining unit 70 is configured to determine a green light duration of each phase according to a width of the time sequence of each phase; and the sending unit 80 is configured to send the green light start time of each phase and the green light duration of each phase to a vehicle-mounted terminal of the moving target, so that the vehicle-mounted terminal of the moving target calculates a guiding speed range according to the green light start time of each phase and the green light duration of each phase, and a vehicle control unit adjusts a vehicle speed according to the guiding speed range.

Further, the calculating unit 30 includes:

calculating a distance of each moving target from the cross intersection according to the current position of each moving target; and calculating the duration for each moving target to reach the cross intersection according to the distance of each moving target from the cross intersection and the current speed of each moving target.

Further, the calculating unit 30 includes:

calculating the duration for each moving target to reach the cross intersection according to the following formula:

$$t_i = s_i / v_i$$

In the above, $t_i$ is the duration for each moving target to reach the cross intersection, $s_i$ is the distance of each moving target from the cross intersection, and $v_i$ is the current speed of each moving target.

Further, the release determining unit 50 includes:

determining the release order of each phase in accordance with the first-come-first-served principle according to the minimum value of the time sequence of the moving targets in each phase reaching the cross intersection.

In the above, the speed of the moving target is not greater than the road speed limit.

Further, the green light duration determining unit 70 includes:

determining a green light duration of each phase according to a difference between the maximum value and the minimum value in the time sequence of each phase.

In the above, preset minimum green light duration≤green light duration of phase≤preset maximum green light duration.

Further, the release determining unit 50 includes:

obtaining an ending moment of the phase according to a green light initial moment, the green light duration, yellow light duration, and full red duration of the phase.

In the above, the green light initial moment of the current phase is arranged in sequence after the ending moment of a previous phase, to serve as the green light initial moment of the current phase.

Further, the apparatus further includes:

a light duration information acquiring unit (not shown), configured to obtain light duration information of each phase according to the green light initial moment, the green light duration, the yellow light duration, and the full red duration of each phase.

Further, the apparatus further includes:

a monitoring unit (not shown), configured to monitoring all moving targets of each phase according to the light duration information;

a remaining duration calculating unit (not shown), configured to calculate remaining duration when all moving targets of each phase pass through the cross intersection; and an allocating unit (not shown), configured to allocate the remaining duration to the next phase.

Further, the apparatus further includes:

a passing request receiving unit (not shown), configured to receive a passing request sent by a vehicle-mounted terminal of a moving target; and a setting unit (not shown), configured to set passing duration as a full red phase according to the passing request, and send the full red phase to the vehicle-mounted terminal of the moving target, so that the vehicle-mounted terminal of the moving target displays the full red phase on a display screen.

In the above, the vehicle-mounted terminal of the moving target is a vehicle-mounted terminal of a special service vehicle.

Further, the apparatus further includes:

a guiding speed range sending unit, configured to send the guiding speed range to an LED display screen, so that the LED display screen displays the guiding speed range.

In the above, the LED display screen is provided above a lane.

Further, the preset minimum green light duration is the duration for ensuring the moving target to pass through the intersection and is set as 15 s, and the preset maximum green light duration is set according to the road traffic flow and not greater than 90 s.

Further, the moving target includes one or more of pedestrian and vehicle.

Further, the apparatus further includes:

a road right request detecting unit, configured to output a traffic signal as a yellow flashing state in case where none of the phases detects a road right request and the time sequence is empty.

Further, the apparatus further includes:

a displaying unit, configured to display the light duration information allocated to each phase on a road section of an electronic map.

An embodiment of the present disclosure provides a vehicle/road interaction signal control apparatus, including: expanding a range of an intersection, extending to an upstream intersection along each vehicle approaching direction, and determining signal phases according to traffic flow conditions; acquiring a current speed and a current position of each moving target in each phase; calculating the duration for each moving target to reach a cross intersection according to the current speed and the current position of each moving target in each phase; obtaining a time sequence of the moving targets in each phase reaching the intersection according to duration for each moving target to reach the cross intersection; determining a release order and a release duration of each phase according to the time sequence of the moving targets in each phase reaching the intersection; sending the above information to a vehicle-mounted terminal; and calculating, by the vehicle-mounted terminal, a guiding speed range in real time according to the information, wherein the vehicle may reach the intersection during a green light period just by adjusting a vehicle speed according to road conditions in combination with the guiding speed range, thus avoiding the delay caused by stopping at the intersection, improving the traffic efficiency of the whole intersection, and reducing the energy consumption.

Embodiment 3

Figure 4:
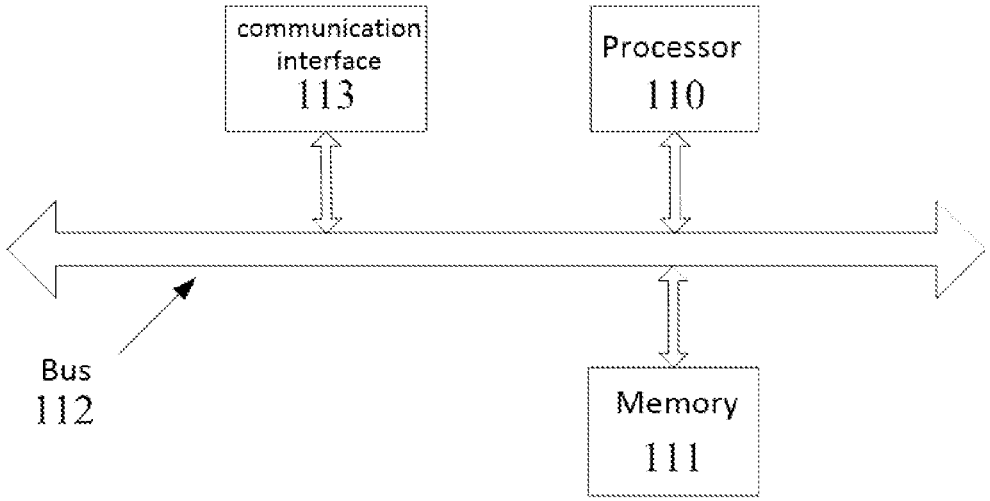
FIG. 4 is a schematic view of an electronic device provided in Embodiment 3 of the present disclosure.

FIG. 4 shows an electronic device provided in an embodiment of the present disclosure, wherein the electronic device includes: a processor 110, a memory 111, a bus 112, and a communication interface 113, wherein the processor 110, the communication interface 113, and the memory 111 are connected via the bus 112; and the processor 110 is configured to execute an executable module, such as a computer program, stored in the memory 111. When executing the computer program, the processor realizes the steps of the method as described in the method embodiment.

In the above, the memory 111 may contain high-speed Random Access Memory (RAM), and also may include non-volatile memory, for example, at least one disk memory.

Communication connection between this system network element and at least one other network element is achieved through at least one communication interface 113 (possibly wired or wireless), and Internet, Wide Area Network, Local Network, Metropolitan Area Network and so on may be used.

The bus 112 may be an ISA bus, a PCI bus, or an EISA bus. The bus may be an address bus, a data bus, a control bus and so on.

For ease of representation, the bus is represented merely with one two-way arrow in FIG. 4, but it does not mean that there is only one bus or one type of bus.

In the above, the memory 111 is configured to store programs, the processor 110 executes the programs upon receipt of an execution instruction. The method executed by the apparatus defined by the process disclosed in any embodiment of the present disclosure in the preceding can be applied to the processor 110, or realized by the processor 110.

The processor 110 may be an integrated circuit chip, with a signal processing function. In an implementation process, various steps of the above method may be completed by an integrated logic circuit of hardware in the processor 110 or instruction in a software form.

The above processor 110 may be a general-purpose processor, including central processing unit (CPU for short), network processor (NP for short), etc., and also may be a digital signal processor (DSP for short), an application specific integrated circuit (ASIC for short), a field-programmable gate array (FPGA for short) or other programmable logic devices, discrete gates, transistor logic devices, or discrete hardware components that can realize or implement various methods, steps, and logic blocks disclosed in the embodiments of the present disclosure. The general-purpose processor may be a microprocessor or the processor also may be any conventional processor and so on.

The steps in the method disclosed in the embodiments of the present disclosure may be directly carried out and completed by hardware decoding processor, or carried out and completed by hardware and software modules in the decoding processor.

The software module may be located in a developed storage medium in the art such as a random access memory, a flash memory, a read-only memory, a programmable read-only memory or an electrically erasable programmable memory, or register. The storage medium is located in the memory 111, and the processor 110 reads information in the memory 111, and is combined with hardware thereof to complete the steps of the above method.

A computer program product provided in an embodiment of the present disclosure includes a computer readable storage medium in which a program code is stored, and instructions included in the program code may be used to execute the method described in the method embodiment in the preceding. Reference may be made to the method embodiment for specific implementation, which will not be repeated redundantly herein.

A person skilled in the art could clearly know that for the sake of convenience and conciseness, reference can be made to corresponding processes in the above method embodiment for specific operation processes of the system and apparatus described in the preceding, and they will not be repeated redundantly herein.

In addition, in the description of the embodiments of the present disclosure, unless otherwise specified and defined explicitly, terms "mount", "join", and "connect" should be construed in a broad sense, for example, a connection can be a fixed connection, a detachable connection, or an integrated connection; it can be a mechanical connection, and also can be an electrical connection; it can be a direct connection, an indirect connection through an intermediary, or an inner communication between two elements. For those ordinarily skilled in the art, specific meanings of the above-mentioned terms in the present disclosure could be understood according to specific circumstances.

If the function is realized in a form of software functional unit and is sold or used as an individual product, it may be stored in one computer readable storage medium.

Based on such understanding, the technical solutions in essence or parts making contribution to the prior art or parts of the technical solutions of the present disclosure can be embodied in form of a software product, and this computer software product is stored in a storage medium, including several instructions for making one computer device (which can be a personal computer, a server or a network device etc.) execute all or part of the steps of the methods of various embodiments of the present disclosure.

The storage medium above includes various media in which program codes can be stored, such as U disk, mobile hard disk, Read-Only Memory (ROM), Random Access Memory (RAM), diskette and compact disk.

In the description of the present disclosure, it should be noted that orientation or positional relations indicated by terms such as "center", "upper", "lower", "left", "right", "vertical", "horizontal", "inner", and "outer" are based on orientation or positional relations as shown in the accompanying drawings, merely for facilitating the description of the present disclosure and simplifying the description, rather than indicating or implying that related devices or elements have to be in the specific orientation, configured and operated in a specific orientation, therefore, they should not be construed as limitation on the present disclosure.

Besides, terms "first", "second", and "third" are merely for descriptive purpose, but should not be construed as indicating or implying importance in the relativity.

Finally, it should be indicated that the embodiments above are merely for specific embodiments of the present disclosure, for illustrating the technical solutions of the present disclosure, rather than limiting the present disclosure. The scope of protection of the present disclosure should not be limited thereto. While the detailed description is made to the present disclosure with reference to the above-mentioned embodiments, those ordinarily skilled in the art should understand that the technical solutions recited in the above-mentioned embodiments still can be modified, or readily changed, or equivalent substitutions can be made to some of the technical features therein; these modifications, changes, or substitutions do not make the corresponding technical solutions essentially depart from the spirit and scope of the technical solutions of the embodiments of the present disclosure, and all should be covered within the scope of protection of the present disclosure. Therefore, the scope of protection of the present disclosure should be determined by the scope of protection of the appended claims.

What is claimed is:

1. A vehicle/road interaction signal control method, wherein the method comprises:

expanding a range of an intersection, which is extended along each vehicle approaching direction, and determining signal phases according to traffic flow conditions, wherein the range of the intersection comprises an intersection dense area and an intersection sparse area, and the extending along each vehicle approaching direction comprises: extending the intersection dense area to an upstream intersection along the vehicle approaching direction, and extending the intersection sparse area to a position at a distance of 2*Cmax*V along the vehicle approaching direction, where V is a road speed limit, and Cmax is a maximum signal period;

acquiring a current speed and a current position of each of moving targets in each of phases;

calculating a duration for each of the moving targets in each of the phases to reach a cross intersection according to the current speed and the current position of each of the moving targets in each of the phases;

ordering the durations for the moving targets in each of the phases to reach the cross intersection in an ascending order, so as to obtain a time sequence of the moving targets in each of the phases reaching the cross intersection;

determining a release order and a release duration of each of the phases according to the time sequence of the moving targets in each of the phases reaching the cross intersection;

determining a green light start time of each of the phases according to a minimum value in the time sequence of each of the phases;

determining a green light duration of each of the phases according to a width of the time sequence of each of the phases; and sending the green light start time of each of the phases and the green light duration of each of the phases to a vehicle-mounted terminal of a moving target, so that the vehicle-mounted terminal of the moving target calculates a guiding speed range according to the green light start time of each of the phases and the green light duration of each of the phases, and a vehicle control unit adjusts a vehicle speed according to the guiding speed range, wherein the determining a green light duration of each of the phases according to a width of the time sequence of each of the phases comprises: determining the green light duration of each of the phases according to a difference between a maximum value and the minimum value in the time sequence of each of the phases, wherein a preset minimum green light duration≤a green light duration of a phase≤a preset maximum green light duration.

2. The vehicle/road interaction signal control method according to claim 1, wherein the calculating a duration for each of the moving targets in each of the phases to reach a cross intersection according to the current speed and the current position of each of the moving targets in each of the phases comprises:

calculating a distance of each of the moving targets from the cross intersection according to the current position of each of the moving targets; and calculating the duration for each of the moving targets to reach the cross intersection according to the distance of each of the moving targets from the cross intersection and the current speed of each of the moving targets.

3. The vehicle/road interaction signal control method according to claim 2, wherein the calculating the duration for each of the moving targets to reach the cross intersection according to the distance of each of the moving targets from the cross intersection and the current speed of each of the moving targets comprises:

calculating the duration for each of the moving targets to reach the cross intersection according to a following formula:

$$t_i = S_i / v_i$$

where $t_i$ is the duration for each of the moving targets to reach the cross intersection, $s_i$ is the distance of each of the moving targets from the cross intersection, and $v_i$ is the current speed of each of the moving targets.

4. The vehicle/road interaction signal control method according to claim 1, wherein the determining a release order and a release duration of each of the phases according to the time sequence of the moving targets in each of the phases reaching the cross intersection comprises: determining the release order of each of the phases in accordance with a first-come-first-served principle according to the minimum value of the time sequence of the moving targets in each of the phases reaching the cross intersection, wherein a speed of a moving target is not greater than the road speed limit.

5. The vehicle/road interaction signal control method according to claim 1, wherein the determining a release order and a release duration of each of the phases according to the time sequence of the moving targets in each of the phases reaching the cross intersection comprises:

obtaining an ending moment of a phase according to a green light initial moment, the green light duration, a yellow light duration, and a full red duration of the phase, wherein a green light initial moment of a current phase is ordered in sequence after an ending moment of a previous phase, so as to serve as the green light initial moment of the current phase.

6. The vehicle/road interaction signal control method according to claim 5, wherein the method further comprises:

obtaining light duration information of each of the phases according to the green light initial moment, the green light duration, the yellow light duration, and the full red duration of each of the phases.

7. The vehicle/road interaction signal control method according to claim 6, wherein the method further comprises:

monitoring all moving targets of each of the phases according to the light duration information;

calculating a remaining duration when all moving targets of each of the phases pass through the cross intersection; and allocating the remaining duration to a next phase.

8. The vehicle/road interaction signal control method according to claim 1, wherein the method further comprises:

receiving a passing request sent by the vehicle-mounted terminal of the moving target; and setting a passing duration as a full red phase according to the passing request, and sending the full red phase to the vehicle-mounted terminal of the moving target, so that the vehicle-mounted terminal of the moving target displays the full red phase on a display screen, wherein the vehicle-mounted terminal of the moving target is a vehicle-mounted terminal of a special service vehicle.

9. The vehicle/road interaction signal control method according to claim 1, wherein the method further comprises:

sending the guiding speed range to an LED display screen, so that the LED display screen displays the guiding speed range, wherein the LED display screen is provided above a lane.

10. The vehicle/road interaction signal control method according to claim 1, wherein the preset minimum green light duration is a duration for ensuring the moving targets to pass through the intersection and is set as 15 s, and the preset maximum green light duration is set according to a road traffic flow and not greater than 90 s.

11. The vehicle/road interaction signal control method according to claim 1, wherein the moving target comprises one or more of pedestrian and vehicle.

12. The vehicle/road interaction signal control method according to claim 1, wherein the method further comprises:

outputting a traffic signal as a yellow flashing state, if none of the phases detects a road right request and then the time sequence is empty.

13. The vehicle/road interaction signal control method according to claim 6, wherein the method further comprises:

displaying the light duration information allocated to each of the phases on a road section of an electronic map.

14. A vehicle/road interaction signal control apparatus, wherein the apparatus comprises:

a phase determining unit, configured to expand a range of an intersection, which is extended along each vehicle approaching direction, and determine signal phases according to traffic flow conditions, wherein the range of the intersection comprises an intersection dense area and an intersection sparse area, and the extending along each vehicle approaching direction comprises: extending the intersection dense area to an upstream intersection along the vehicle approaching direction, and extending the intersection sparse area to a position at a distance of 2*Cmax*V along the vehicle approaching direction, where V is a road speed limit, and Cmax is a maximum signal period;

an acquiring unit, configured to acquire a current speed and a current position of each of moving targets in each of phases;

a calculating unit, configured to calculate a duration for each of the moving targets in each of the phases to reach a cross intersection according to the current speed and the current position of each of the moving targets in each of the phases;

an ordering unit, configured to order durations for the moving targets in each of the phases to reach the cross intersection in an ascending order, so as to obtain a time sequence of the moving targets in each of the phases reaching the cross intersection;

a release determining unit, configured to determine a release order and a release duration of each of the phases according to the time sequence of the moving targets in each of the phases reaching the cross intersection;

a green light start time determining unit, configured to determine a green light start time of each of the phases according to a minimum value in the time sequence of each of the phases;

a green light duration determining unit, configured to determine a green light duration of each of the phases according to a width of the time sequence of each of the phases; and a sending unit, configured to send the green light start time of each of the phases and the green light duration of each of the phases to a vehicle-mounted terminal of a moving target, so that the vehicle-mounted terminal of the moving target calculates a guiding speed range according to the green light start time of each of the phases and the green light duration of each of the phases, and a vehicle control unit adjusts a vehicle speed according to the guiding speed range, wherein the green light duration determining unit is configured to:

determine the green light duration of each of the phases according to a difference between a maximum value and the minimum value in the time sequence of each of the phases, wherein a preset minimum green light duration≤a green light duration of a phase≤a preset maximum green light duration.

15. The vehicle/road interaction signal control apparatus according to claim 14, wherein the calculating unit is configured to:

calculate a distance of each of the moving targets from the cross intersection according to the current position of each of the moving targets; and calculate the duration for each of the moving targets to reach the cross intersection according to the distance of each of the moving targets from the cross intersection and the current speed of each of the moving targets.

16. The vehicle/road interaction signal control apparatus according to claim 15, wherein the calculating unit is configured to:

calculate the duration for each of the moving targets to reach the cross intersection according to a following formula:

$$t_i = s_i / v_i$$

where $t_i$ is the duration for each of the moving targets to reach the cross intersection, $s_i$ is the distance of each of the moving targets from the cross intersection, and $v_i$ is the current speed of each of the moving targets.

17. The vehicle/road interaction signal control apparatus according to claim 14, wherein the release determining unit is configured to:

determine the release order of each of the phases in accordance with a first-come-first-served principle according to the minimum value of the time sequence of the moving targets in each of the phases reaching the cross intersection, wherein a speed of a moving target is not greater than the road speed limit.

18. The vehicle/road interaction signal control apparatus according to claim 14, wherein the release determining unit is configured to:

obtain an ending moment of a phase according to a green light initial moment, the green light duration, a yellow light duration, and a full red duration of the phase, wherein a green light initial moment of a current phase is ordered in sequence after an ending moment of a previous phase, so as to serve as the green light initial moment of the current phase.

19. The vehicle/road interaction signal control apparatus according to claim 18, wherein the apparatus further comprises:

a light duration information acquiring unit, configured to obtain light duration information of each of the phases according to the green light initial moment, the green light duration, the yellow light duration, and the full red duration of each of the phases.

20. An electronic device, comprising a memory and a processor, wherein the memory stores computer programs executable on the processor, wherein the processor implements steps of the method according to claim 1 when executing the computer programs.

* * * * *